United States Patent [19]

Okumura et al.

[11] Patent Number: 4,516,544

[45] Date of Patent: May 14, 1985

[54] HELICALLY-SHAPED INTAKE PORT OF AN INTERNAL-COMBUSTION ENGINE

[75] Inventors: Takeshi Okumura; Kiyoshi Nakanishi, both of Susono; Mikio Nakajima, Okazaki, all of Japan

[73] Assignee: Toyota Jidosha Kabushiki Kaisha, Aichi, Japan

[21] Appl. No.: 494,387

[22] Filed: May 13, 1983

[30] Foreign Application Priority Data

May 25, 1982 [JP] Japan ..... 57-087210
May 25, 1982 [JP] Japan ..... 57-087206

[51] Int. Cl.[3] ..... F02F 1/42
[52] U.S. Cl. ..... 123/188 M; 123/308
[58] Field of Search ..... 123/52 M, 188 M, 306, 123/308, 432

[56] References Cited

U.S. PATENT DOCUMENTS

| | | | |
|---|---|---|---|
| 3,850,479 | 11/1974 | Boyhont et al. | 302/29 |
| 3,884,209 | 5/1975 | List et al. | 123/188 M |
| 4,159,011 | 6/1979 | Sperry | 123/188 M |
| 4,174,686 | 11/1979 | Shimizu et al. | 123/308 |
| 4,201,165 | 5/1980 | Tanaka et al. | 123/568 |
| 4,246,874 | 1/1981 | Nakagawa et al. | 123/308 |
| 4,253,432 | 3/1981 | Nohira et al. | 123/52 M |
| 4,256,062 | 3/1981 | Schafer | 123/52 M |
| 4,257,384 | 3/1981 | Matsumoto | 123/575 |
| 4,286,554 | 9/1981 | Okamoto | 123/188 M |
| 4,312,309 | 1/1982 | Nakanishi | 123/188 M |
| 4,411,226 | 10/1983 | Okumura et al. | 123/188 M |
| 4,438,741 | 3/1984 | Okumura et al. | 123/188 M |

FOREIGN PATENT DOCUMENTS

| | | | |
|---|---|---|---|
| 2059008 | 6/1972 | Fed. Rep. of Germany . | |
| 0143289 | 8/1980 | German Democratic Rep. | 123/188 M |
| 52-127113 | 9/1977 | Japan . | |
| 54-58129 | 5/1979 | Japan . | |
| 0035177 | 3/1980 | Japan | 123/188 M |
| 56-54922 | 5/1981 | Japan . | |
| 57-68519 | 4/1982 | Japan . | |
| 0183521 | 11/1982 | Japan | 123/306 |
| 0028525 | 2/1983 | Japan | 123/306 |

*Primary Examiner*—Ira S. Lazarus
*Attorney, Agent, or Firm*—Parkhurst & Oliff

[57] ABSTRACT

An engine comprising an intake port which has a separating wall projecting downwardly from the upper wall of the intake port. The separating wall defines a helical portion, an inlet passage portion tangentially connected to the helical portion, and a bypass passage interconnecting the inlet passage portion and the helical portion. The side wall of the helical portion has a slightly inclined portion located near the outlet portion of the bypass passage and expanding towards the separating wall so as to define a narrow passage portion between the inclined portion and the separating wall. A rotary valve is arranged in the bypass passage and is actuated by a vacuum-operated diaphragm apparatus. The rotary valve is opened when the amount of air fed into the cylinder of the engine is increased beyond a predetermined value.

25 Claims, 10 Drawing Figures

HELICALLY-SHAPED INTAKE PORT OF AN INTERNAL-COMBUSTION ENGINE

BACKGROUND OF THE INVENTION

The present invention relates to a helically-shaped intake port of an internal-combustion engine.

A helically-shaped intake port normally comprises a helical portion formed around the intake valve of an engine and a substantially straight inlet passage portion tangentially connected to the helical portion. However, if such a helically-shaped intake port is so formed that a strong swirling motion is created in the combustion chamber of an engine when the engine is operating at a low speed under a light load, that is, when the amount of air fed into the cylinder of the engine is small, since air flowing within the helically-shaped intake port is subjected to a great flow resistance, a problem occurs in that the volumetric efficiency is reduced when the engine is operating at a high speed under a heavy load, that is, when the amount of air fed into the cylinder of the engine is large.

In order to eliminate such a problem, the present inventor previously proposed a helically-shaped intake port in which a bypass passage, branched off from the inlet passage portion and connected to the helix-terminating portion of the helical portion, is formed in the cylinder head of an engine. A flow control valve is arranged in the bypass passage and is open when the engine is operating under a heavy load at a high speed. In this helically-shaped intake port, when the engine is operating under a heavy load at a high speed, a part of the air introduced into the inlet passage portion is fed into the helical portion of the helically-shaped intake port via the bypass passage. Consequently, since the flow area of the intake port is increased when the engine is operating under a heavy load at a high speed, it is possible to increase the volumetric efficiency. However, in this helically-shaped intake port, since the bypass passage is formed by a tubular passage which is completely separated from the inlet passage portion, the bypass passage has a relatively great flow resistance. In addition, since it is necessary to form the bypass passage adjacent to the inlet passage portion, the cross-sectional area of the bypass passage is restricted by the presence of the inlet passage portion. Consequently, it is difficult to obtain a satisfactory high volumetric efficiency. In addition, the helically-shaped intake port has a complicated construction itself, and, thus, if a bypass passage completely separated from the inlet passage portion is additionally provided, the entire construction of the intake port becomes extremely complicated. Therefore, it is considerably difficult to form a helically-shaped intake port equipped with such a bypass passage in the cylinder head.

SUMMARY OF THE INVENTION

An object of the present invention is to provide a helically-shaped intake port having a novel construction which can be easily manufactured and which is capable of obtaining a high volumetric efficiency when the engine is operating under a heavy load at a high speed.

According to the present invention, there is provided an intake device of an internal-combustion engine comprising: an intake valve having a valve stem; an axially extending intake port passage having an inlet opening at one end thereof and an outlet opening at the other end thereof, the intake port passage having a substantially cylindrically extending circumferential wall which circumferentially extends about the valve stem, a first side wall which extends between the inlet opening and the circumferential wall along an axis of the intake port passage, a second side wall which extends between the inlet opening and the circumferential wall along the axis of the intake port passage and is arranged so that it faces the first side wall, an upper wall which extends between the inlet opening and the circumferential wall along the axis of the intake port passage, and a bottom wall which extends between the inlet opening and the circumferential wall along the axis of the intake port passage; a separating wall projecting downwardly from the upper wall and spaced from the bottom wall, the separating wall extending along the axis of the intake port passage and being spaced from the circumferential wall so as to define a helical portion having a helix-terminating portion between the separating wall and the circumferential wall, the separating wall having a first side wall spaced from the first side wall of the intake port passage so as to define therebetween an inlet passage portion tangentially connected to the helical portion, the separating wall having a second side wall spaced from the second side wall of the intake port passage so as to defline therebetween a bypass passage which interconnects the inlet passage portion and the helix-terminating portion, the second side wall of the separating wall having an expansion portion which expands towards the circumferential wall and is located in the helical portion in the vicinity of an outlet portion of the bypass passage, the circumferential wall having an expanding portion which expands towards the expanding portion of the second side wall of the separating wall so as to define a first narrow passage portion between the expanding portions; normally closed valve means arranged in the bypass passage for controlling the flow area of the bypass passage; and actuating means for actuating the valve means in response to the change in the operating condition of the engine to open the valve means when the engine is operating a a high speed under a heavy load.

The present invention may be more fully understood from the description of a preferred embodiment thereof set forth below, together with the accompanying drawings.

DESCRIPTION OF THE PREFERRED EMBODIMENT

Figure 1:
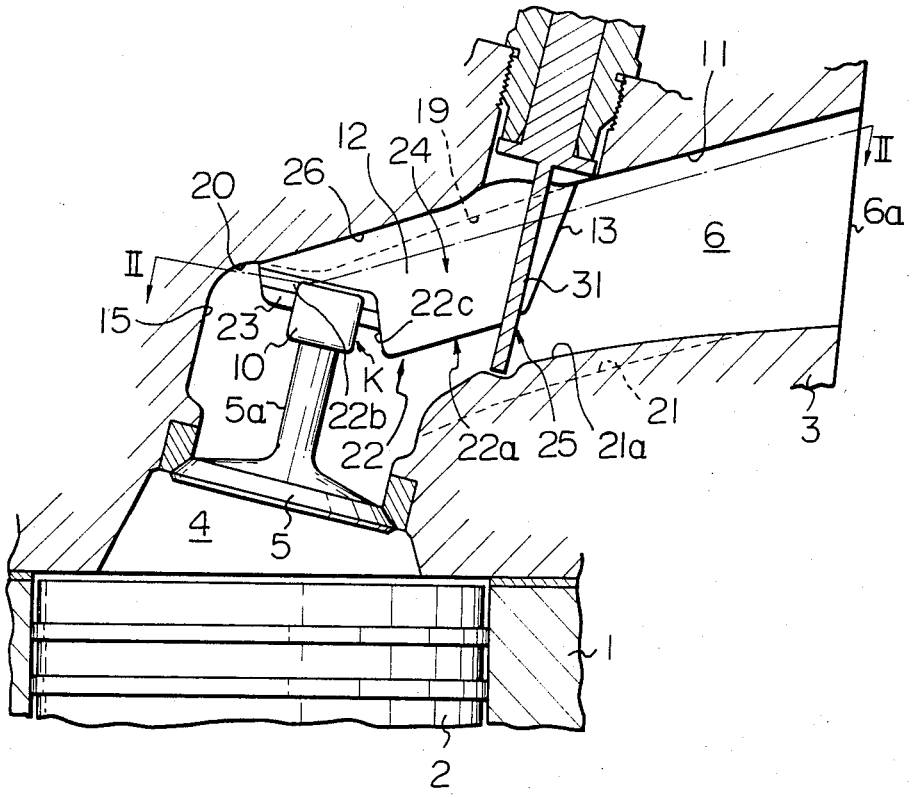
FIG. 1 is a cross-sectional side view along the line I—I in FIG. 2 of an internal-combustion engine according to the present invention.
Figure 2:
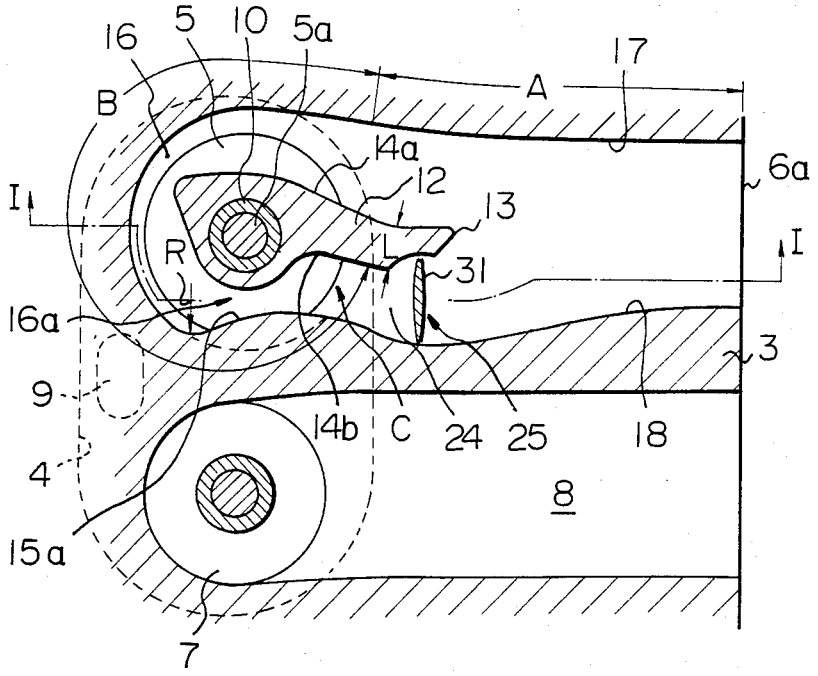
FIG. 2 is a cross-sectional plan view along the line II—II in FIG. 1 of the internal-combustion engine of FIG. 1.
Figure 3:
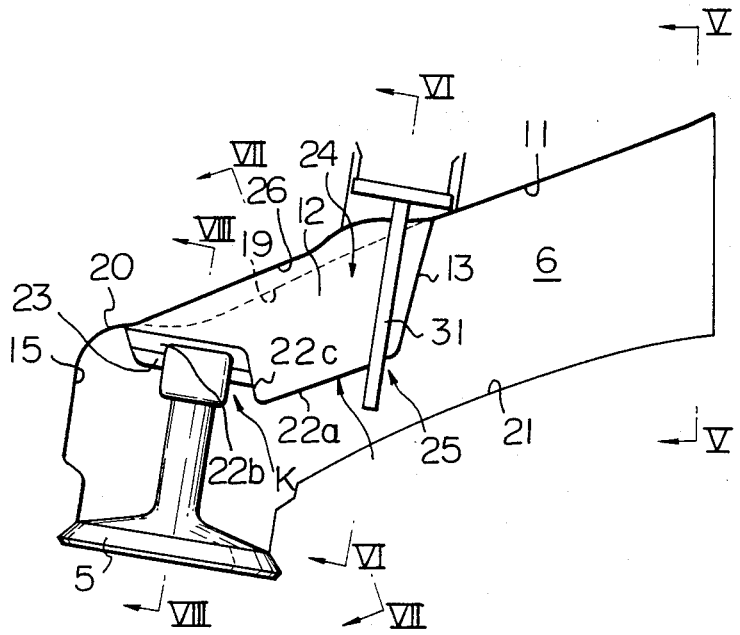
FIG. 3 is a side view of a helically-shaped intake port according to the present invention schematically illustrating the shape thereof.

Referring to FIGS. 1 and 2, reference numeral 1 designates a cylinder block, 2 a piston reciprocally movable in the cylinder block 1, 3 a cylinder head fixed onto the cylinder block 1, 4 a combustion chamber formed between the piston 2 and the cylinder head 3, 5 an intake valve, 6 a helically-shaped intake port formed in the cylinder head 3, 7 an exhaust valve, 8 an exhaust port formed in the cylinder head 3, 9 a spark plug arranged in the combustion chamber 4, and 10 a stem guide for guiding the stem 5*a* of the intake valve 5. As is illustrated in FIGS. 1 and 2, a downwardly projecting separating wall 12 is formed in one piece on the upper wall 11 of the intake port 6, and the helical portion B and the inlet passage portion A tangentially connected to the helical portion B as formed by the separating wall 12. The separating wall 12 extends from the interior region of the inlet passage portion A to the region around the stem 5*a* of the intake valve 5. As can be seen from FIG. 2, the root portion of the separating wall 12 has a narrow width portion near the inlet opening 6*a* of the intake valve 6, and the width L of the root portion of the separating wall 12 is maintained approximately constant between the narrow width portion and a position near the stem guide 10 and becomes wide around the stem guide 10. The separating wall 12 has a tip portion 13 near the inlet opening 6*a* of the intake port 6. In addition, the separating wall 12 comprises a first side wall 14*a* extending in a counterclockwise direction in FIG. 2 from the tip portion 13 and a second side wall 14*b* extending in a clockwise direction in FIG. 2 from the tip portion 13. The first side wall 14*a* extends near the stem guide 10 from the tip portion 13 to near the side wall 15 of the helical portion B, and the first side wall 14*a* and the side wall 15 define a narrow passage portion 16 therebetween. On the other hand, the second side wall 14*b* of the separating wall 12 extends from the tip portion 13 towards the stem guide 10 so that the distance between the second side wall 14*b* and the first side wall 14*a* is initially increased and then maintained approximately constant. Then the second side wall 14*b* extends along the outer circumferential wall of the stem guide 10 to the narrow passage portion 16.

Referring to FIGS. 1 through 9, the side wall 17 of the inlet passage portion A is substantially vertically arranged, and the side wall 18 of the inlet passage portion A is slightly inclined so as to be directed downward. The upper wall 19 of the inlet passage portion A gradually descends towards the helical portion B and is smoothly connected to the upper wall 20 of the helical portion B. The upper wall 20 of the helical portion B gradually descends towards the narrow passage portion 16 from the connecting portion of the inlet passage portion A and the helical portion B. In addition, the width of the upper wall 20 of the helical portion B is gradually reduced towards the narrow passage portion 16 from the connecting portion of the inlet passage portion A and the helical portion B. Then the width of the upper wall 20 is gradually increased towards the helix-terminating portion C of the helical portion B from the narrow passage portion 16. The side wall 17 of the inlet passage portion A is smoothly connected to the side wall 15 of the helical portion B, and the bottom wall 21 of the inlet passage portion A descends towards the helical portion B.

Figure 8:
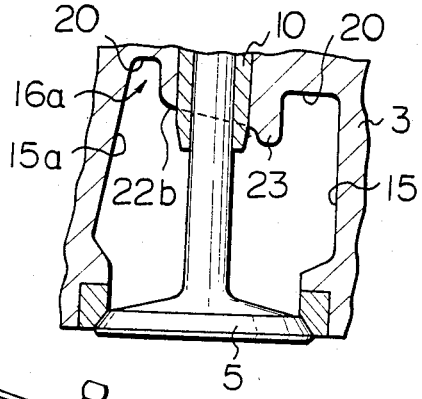
FIG. 8 is a cross-sectional view along the line VIII—VIII in FIG. 3 of the intake port of FIG. 3.

The first side wall 14*a* of the separating wall 12 is slightly inclined so as to be directed downward, and the second side wall 14*b* is substantially vertically arranged. The bottom face 22 of the separating wall 12 comprises a first bottom face portion 22*a* extending from the tip portion 13 to near the stem guide 10 and a second bottom wall portion 22*b* located around the stem guide 10. The first bottom wall portion 22*a* extends substantially parallel to the upper wall 19 and is located near the bottom wall 21. The height of the second bottom face portion 22*b*, which is measured from the upper wall 19, is lower than that of the first bottom face portion 22*a*, and, thus, a step portion 22*c* is formed between the first bottom face portion 22*a* and the second bottom face portion 22*b*. In addition, the distance between the second bottom face portion 22*b* and the upper wall 19 is gradually reduced towards the narrow passage portion 16. The lower end of the stem guide 10 projects downwardly from the second bottom face portion 22*b*, and a gap K is formed between the step portion 22*c* and the projecting lower end of the stem guide 10. A downwardly projecting rib 23 is formed on the second bottom face portion 22*b* in the region indicated by the hatching in FIG. 4, and the rib 23 extends from the step portion 22*c* to the narrow passage portion 16. As is illustrated in FIG. 8, the second bottom face portion 22*b* descends towards the rib 23.

Figure 4:
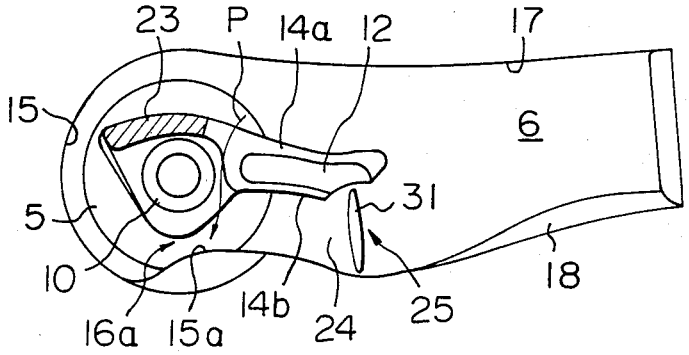
FIG. 4 is a plan view of a helically-shaped intake port according to the present invention schematically illustrating the shape thereof.
Figure 5:
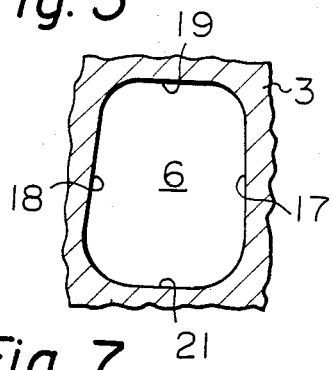
FIG. 5 is a cross-sectional view along the line V—V in FIG. 3 of the intake port of FIG. 3.
Figure 6:
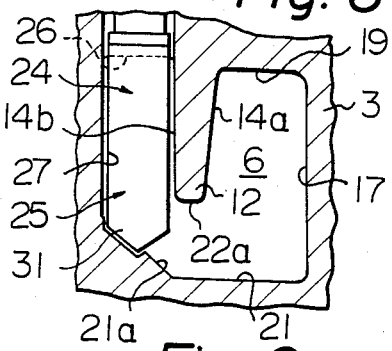
FIG. 6 is a cross-sectional view along the line VI—VI in FIG. 3 of the intake port of FIG. 3.
Figure 7:
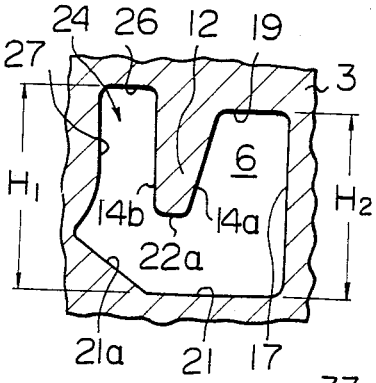
FIG. 7 is a cross-sectional view along the line VII—VII in FIG. 3 of the intake port of FIG. 3.

A bypass passage 24, interconnecting the inlet passage portion A and the helix-terminating portion C of the helical portion B, is formed in the cylinder head 3, and a rotary valve 25 is arranged in the inlet portion of the bypass passage 24. The bypass passage 24 is separated from the inlet passage portion A by the separating wall 12, and the lower space of the bypass passage 24 is in communication with the inlet passage portion A over the entire length of he bypass passage 24. The upper wall 26 of the bypass passage 24 has an approximately uniform width. The upper wall 26 gradually descends towards the helix-terminating portion C and is smoothly connected to the upper wall 20 of the helical portion B. As is illustrated in FIG. 7, the height $H_1$ of the upper wall 26 of the bypass passage 24, which height is measured from the bottom wall 21, is higher than the height $H_2$ of the upper wall 19 of the inlet passage portion A. The side wall 27 of the bypass passage 24, which faces the second side wall 14*b* of the separating wall 12, is substantially vertically arranged, and the bottom wall portion 21*a*, located beneath the bypass passage 24, is raised and forms an inclined wall. As will be understood from FIG. 1, the bottom wall portion 21*a* extends to the helical portion B from near the inlet opening 6*a* of the intake port 6. As is illustrated in FIGS. 1, 4, and 8, the side wall portion 15*a* of the side wall 15 of the helical portion B, which side wall portion is located near the outlet portion of the bypass passage 24, is slightly inclined so as to be directed downward and expands towards the stem 5*a* of the intake valve 5 relative to the remaining portion of the side wall 15 of the helical portion B. The side wall portion 15*a* is smoothly connected to the side wall 15 of the helical portion B, and, in addition, the connecting portion of the side wall portion 15*a* and the side wall 15 has an arc shape with radius R, as is illustrated in FIG. 2. The second side wall 14*b* of the separating wall 12 expands towards the inclined side wall portion 15*a*, and, thus, another narrow passage portion 16*a* is formed between the second side wall 14*b* and the inclined side wall portion 15*a*.

Figure 9:
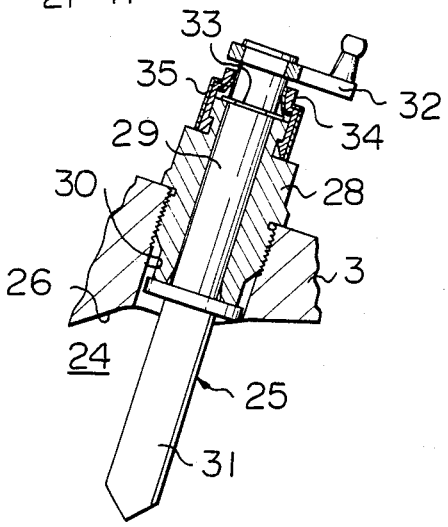
FIG. 9 is a cross-sectional side of a rotary valve.

As is illustrated in FIG. 9, the rotary valve 25 comprises a rotary valve holder 28 and a valve shaft 29 rotatably supported by the rotary valve holder 28. The rotary valve holder 28 is screwed into a valve insertion bore 30 formed in the cylinder head 3. A thin plate-shaped valve body 31 is formed on the lower end of the valve shaft 29 and extends between the bottom wall 21 of the inlet passage portion A and the upper wall 26 of the bypass passage 24, as is illustrated in FIG. 1. An arm 32 is fixed onto the top end of the valve shaft 29. A ring groove 33 is formed on the outer circumferential wall of the valve shaft 29, and an E-shaped positioning ring 34 is fitted into the ring groove 33. In addition, a seal member 35 is fitted onto the upper portion of the rotary valve holder 28, and the seal member 35 seals the valve shaft 29.

Figure 10:
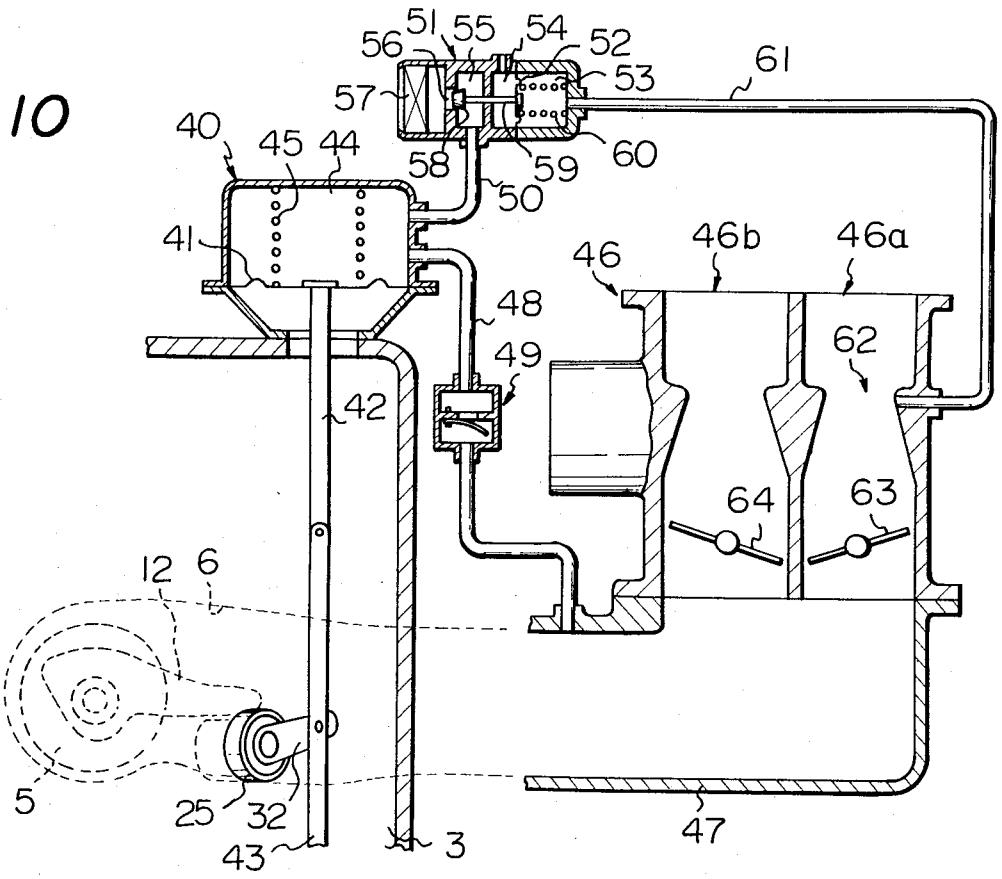
FIG. 10 is a view of a rotary valve drive control device.

Referring to FIG. 10, the tip of the arm 32 fixed onto the top end of the rotary valve 25 is connected via a connecting rod 43 to a control rod 42 which is fixed onto a diaphragm 41 of a vacuum-operated diaphragm apparatus 40. The diaphragm apparatus 40 comprises a vacuum chamber 44 separated from the atmosphere by the diaphragm 41, and a compression spring 45 for biasing the diaphragm 41 is inserted into the vacuum chamber 44.

An intake manifold 47, equipped with a compound-type carburetor 46 comprising a primary carburetor 46*a* and a secondary carburetor 46*b*, is mounted on the cylinder head 3, and the vacuum chamber 44 is connected to the interior of the intake manifold 47 via a vacuum conduit 48. A check valve 49, permitting air to flow from the vacuum chamber 44 into the intake manifold 47, is arranged in the vacuum conduit 48. In addition, the vacuum chamber 44 is connected to the atmosphere via an atmosphere conduit 50 and a control valve 51. The control valve 51 comprises a vacuum chamber 53 and an atmospheric pressure chamber 54 which are separated by a diaphragm 52. In addition, the control valve 51 further comprises a valve chamber 55 arranged adjacent to the atmospheric pressure chamber 54. The valve chamber 55 is connected at one end to the vacuum chamber 44 via the atmosphere conduit 50 and at the other end to the atmosphere via a valve port 56 and an air filter 57. A valve body 58, controlling the opening operation of the valve port 56, is arranged in the valve chamber 55 and is connected to the diaphragm 52 via a valve rod 59. A compression spring 60 for biasing the diaphragm 52 is inserted into the vacuum chamber 53, and the vacuum chamber 53 is connected to a venturi portion 62 of the primary carburetor 46*a* via a vacuum conduit 61.

The carburetor 46 is a conventional carburetor. Consequently, when the opening degree of a primary throttle valve 63 is increased beyond a predetermined degree, a secondary throttle valve 64 is opened. When the primary throttle valve 63 is fully opened, the secondary throttle valve 64 is also fully opened. The level of vacuum produced in the venturi portion 62 of the primary carburetor 46*a* is increased as the amount of air fed into the cylinder of the engine is increased. Consequently, when a great vacuum is produced in the venturi portion 62, that is, when the engine is operating at a high speed under a heavy load, the diaphragm 52 of the control valve 51 moves towards the right in FIG. 10 against the compression spring 60. As a result, the valve body 58 opens the valve port 56. Thus, the vacuum chamber 44 the valve port 56. Thus, the vacuum chamber 44 of the diaphragm apparatus 40 becomes open to the atmosphere. At this time, the diaphragm 41 moves downward in FIG. 10 due to the spring force of the compression spring 45, and, thus, the rotary valve 25 is rotated and fully opens the bypass passage 24.

On the other hand, in the case wherein the opening degree of the primary throttle valve 63 is small, since the vacuum produced in the venturi portion 62 is small, the diaphragm 52 of the control valve 51 moves towards the left in FIG. 10 due to the spring force of the compression spring 60. As a result, the valve body 58 closes the valve port 56. In addition, in the case wherein the opening degree of the primary throttle valve 63 is small, a great vacuum is produced in the intake manifold 47. Since the check valve 49 opens when the level of vacuum produced in the intake manifold 47 becomes greater than that of the vacuum produced in the vacuum chamber 44 and since the check valve 49 closes when the level of the vacuum produced in the intake manifold 47 becomes less that that of the vacuum produced in the vacuum chamber 44, the level of the vacuum in the vacuum chamber 44 is maintained at the maximum vacuum level in the intake manifold 47 as long as the control valve 51 remains closed. If a vacuum is produced in the vacuum chamber 44, the diaphragm 41 moves upward in FIG. 10 against the compression spring 45. As a result, the rotary valve 25 is rotated and closes the bypass passage 24. Consequently, when the engine is operating at a low speed under a light load, the bypass passage 24 is closed by the rotary valve 25. In the case wherein the engine speed is low even if the engine is operating under a heavy load and in the case wherein the engine is operating under a light load even if the engine speed is high, since the vacuum produced in the venturi portion 62 is small, the control valve 51 remains closed. Consequently, when the engine is operating at a low speed under a heavy load and at a high speed under a light load, since the level of the vacuum in the vacuum chamber 44 is maintained at the above-mentioned maximum level, the bypass passage 24 is closed by the rotary valve 25.

As was mentioned above, when the engine is operating at a low speed under a light load, that is, when the amount of air fed into the cylinder of the engine is small, the rotary valve 25 closes the bypass passage 24. At this time, a part of the mixture introduced into the inlet passage portion A moves forward along the upper walls 19, 20. In addition, at this time, a part of the remaining mixture impinges upon the rotary valve 25, and the flow direction thereof is deflected towards the side wall 17 of the inlet passage portion A. Then the part of the remaining mixture moves forward along the side wall 15 of the helical portion B. As was mentioned above, since the widths of the upper walls 19, 20 are gradually reduced towards the narrow passage portion 16, the cross section of the flow path of the mixture flowing along the upper walls 19, 20 is gradually reduced towards the narrow passage portion 16. Thus, the velocity of the mixture flowing along the upper walls 19, 20 is gradually increased. In addition, as was mentioned above, since the first side wall 14*a* of the separating wall 12 extends to near the side wall 15 of the helical portion B, the mixture flowing along the upper walls 19, 20 is led onto the side wall 15 of the helical portion B. Then when the mixture reaches the side wall portion 15*a*, the flow direction of the mixture is turned towards the stem 5*a* of the intake valve 5 by the side wall portion 15*a*. As a result, a strong swirling motion is created in the helical portion B. Then the swirling mixture flows into the combustion chamber 4 via the valve gap formed between the intake valve 5 and its valve seat and causes a strong swirling motion in the combustion chamber 4. The side wall portion 15*a* provides a further swirling force for the mixture swirling along the side wall 15 of the helical portion B. In addition, the side wall portion 15*a* prevents the mixture from flowing into the bypass passage 24 and thus prevents the swirling motion from being weakened. Consequently, it is possible to create a stronging swirl motion. When the engine is operating at a low speed under a light load, a part of the mixture flows into the helical portion B from the inlet passage portion A via the gap K formed between the stem guide 10 and the step portion 22*c*, as is illustrated by the arrow P in FIG. 4. However, at this time, since the amount of air fed into the cylinder of the engine is small, the amount of the mixture flowing within the gasp K is extremely small, and, thus, there is no danger of the swirling motion being weakened by the mixture flowing into the helical portion B via the gap K.

When the engine is operating at a high speed under a heavy load, that is, when the amount of air fed into the cylinder of the engine is large, since the rotary valve 25 opens the bypass passage 24, the mixture introduced into the inlet passage portion A is divided into three mixture streams. That is, the first mixture streams is a mixture stream which flows into the intake port 6 between the first side wall 14*a* of the separating wall 12 and the side wall 17 of the inelt passage portion A and then flows, while swirling, along the upper wall 20 of the helical portion B. The second mixture stream is a mixture stream which flows into the helical portion B through the bypass passage 24. The third mixture stream is a mixture stream which flows into the helical poriton B along the bottom wall 21 of the inlet passage portion A. The flow resistance of the bypass passage 24 is smaller than that of the flow path formed between the first side wall 14*a* and the side wall 17, and, thus, the amount of the second mixture stream is larger than that of the first mixture stream. In addition, since the narrow passage portion 16*a* is formed near the outlet portion of the bypass passage 24, the speed of the mixture flowing out of the bypass passage 24 is increased when the mixture passes through the narrow passage portion 16*a*. Then this mixture obliquely impinges upon the upper side of the first mixture stream swirling along the side wall 15 of the helical poriton B and deflects the flow derection of the first mixture stream downward. As a result, the swirling motion is weakened. In addition, when the engine is operating under a heavy load at a high speed, the amount of air fed into the cylinder of the engine is increased, and, thus, the amount of the mixture flowing into the helical portion B from the inlet passage portion A via the gap K, as is illustrated by the arrow P in FIG. 4, is increased. Consequently, the first mixture stream flowing between the side wall 17 and the first side wall 14*a* of the separating wall 12 flows, while spreading, into the helical portion B, and, thus, the swirling motion is weakened. As was mentioned above, since a large amount of the mixtrue flows into the helical portion B from the bypass passage 24 having a small flow resistance and since the swirling motion caused by the first mixture streams is weakened, it is possible to obtain a high volumetric efficiency.

In the present invention, the intake port 6 can be formed by forming the separating wall 12 in one piece on the upper wall of the intake port 6. Consequently, it is possible to easily manufacture the helically-shaped intake port.

According to the present invention, when the engine is operating under a ligh load at a low speed, since the bypass passage is closed, a large amount of the mixture is caused to flow along the upper wall of the helical portion. As a result, since the flow direction of the mixture flowing along the side wall of the helical portion is deflected towards the stem of the intake valve by the side wall portion of the helical portion, which expands towards the stem of the intake valve, it is possible to create a strong swirling motion in the combustion chamber. When the engine is operating under a heavy load at a high speed, since the bypass passage is open, a larger amount of the mixture flows into the helical portion via the bypass passage having a low flow resistance. In addition, at this time, since the swirling motion caused by the first mixture stream is weakened, it is possible to obtain a high volumetric efficiency.

While the invention has been described with reference to a specific embodiment chosen for purposes of illustration, it should be apparent that numerous modifications could be made thereto by those skilled in the art without departing from the basic concept and scope of the invention.

We claim:

1. An intake device of an internal-combustion engine comprising:

an intake valve having a valve stem;

an axially extending intake port passage having an inlet opening at one end thereof and an outlet opening at the other end thereof, said intake port passage having a substantially cylindrically extending circumferential wall which circumferentially extends about said valve stem, a first side wall which extends between said inlet opening and said circumferential wall along an axis of said intake port passage, a second side wall which extends between said inlet opening and said circumferential wall along the axis of said intake port passage and is arranged so that it faces said first side wall, an upper wall which extends between said inlet opening and said circumferential wall along the axis of said intake port passage, and a bottom wall which extends between said inlet opening and said circumferential wall along the axis of said intake port passage;

a separating wall projecting downwardly from said upper wall and spaced from said bottom wall, said separating wall extending along the axis of said intake port passage and being spaced from said circumferential wall so as to define a helical poriton having a helix-terminating poriton between said separating wall and said circumferential wall, said separating wall having a first side wall spaced from the first side wall of said intake port passage so as to define therebetween an inlet passage portion tangentially connected to said helical portion, said separating wall having a second side wall spaced from the second side wall of said intake port passage so as to define therebetween a bypass passage which interconnects said inlet passage portion and said helix-terminating poriton, the second side wall of said separating wall having an expansion portion which expands towards said circumferential wall and which is located in said helical portion in the vicinity of an outlet portion of said bypass passage, said circumferential wall having an expanding portion which expands towards the expanding portion of the second side wall of said separating wall so as to define a first narrow passage portion between said expanding protions;

normally closed valve means arrnaged in said bypass passage for controlling the flow area of said bypass passage; and actuating means for actuating said vlave means in response to the change in the operating condition of the engine to open said valve means when the engine is operating at a high speed under a heavy load.

2. An intake device according to claim 1, wherein the expanding portion of said circumferential wall is slightly inclined so as to be directed downward.

3. An intake device according to claim 1, wherein the expanding portion of said circumferential wall is smoothly connected to both said circumferential wall and the second side wall of said intake port passage.

4. An intake device accoridng to claim 1, wherein said separating wall has a bottom face spaced from the bottom wall of said intake port passage, said bottom face comprising a first bottom face portion which is located near said inlet opening and which extends to near the bottom wall of said intake port passage, a second bottom face portion which is arranged around said valve stem and has a height lower than the height of said first bottom face portion, and a step portion formed between said first bottom face portion and said second bottom face portion, a portion of said separating wall, which defines said second bottom face portion, defining the expanding portion of the second side wall of said separating wall.

5. An intake device according to claim 4, wherein a stem guide supporting said valve stem projects downwardly from said second bottom face portion at a position spaced from said step portion, a gap being formed between said stem guide and said step portion.

6. An intake device according to claim 4, wherein a downwardly projecting rib is formed on said second bottom face portion and is arranged on the extension of the first side wall of said separating wall.

7. An intake device according to claim 6, wherein said second bottom face portion slightly descends towards said rib.

8. An intake device according to claim 1, wherein said separating wall extends to near said circumferential wall so as to define a second narrow passage portion therebetween.

9. An intake device according to claim 8, wherein said second narrow passage portion is located opposite the outlet portion of said bypass passage with respect to said valve stem.

10. An intake device according to claim 9, wherein said upper wall, located between said circumferential wall and the second side wall of said separating wall, has a width which is gradually increased from said second narrow passage portion towards said first narrow passage portion.

11. An intake device according to claim 1, wherein the first side wall of said separating wall is slightly inclined so as to be directed downward.

12. An intake device according to claim 1, wherein the second side wall of said separating wall is substantially vertically arranged.

13. An intake device according to claim 1, wherein the first side wall of said intake port passage is substantially vertically arranged.

14. An intake device according to claim 1, wherein the second side wall of said intake port passage is substantially vertically arranged in a region of said bypass passage, said bypass passage having a substantially uniform transverse width over the entire length thereof.

15. An intake device according to claim 1, wherein said upper wall, located between the first side wall of said intake port passage and the first side wall of said separating wall, has a width which is gradually reduced towards said helical portion.

16. An intake device according to claim 1, wherein said bottom wall has an inclined portion located beneath said bypass passage.

17. An intake device according to claim 1, wherein said bypass passage has an inlet portion which is open to said inlet passage portion, said valve means being arranged in said inlet portion.

18. An intake device according to claim 1, wherein said valve means comprises a rotary valve rotatably arranged in said bypass passage.

19. An intake device according to claim 18, wherein said rotary valve has a thin plate-shaped valve body extending between said upper wall and said bottom wall.

20. An intake device according to claim 19, wherein said valve body has a width which is substantially equal to the transverse width of said bypass passage.

21. An intake device according to claim 1, wherein said actuating means actuates said valve means in response to the amount of air fed into said intake port passage and opens said valve means when said amount of air is increased beyond a predetermined value.

22. An intake device according to claim 21, wherein said actuating means comprises a vacuum chamber, a diaphragm connected to said rotary valve and actuated in response to a change in the level of the vacuum in said vacuum chamber, and a control apparatus maintaining the level of the vacuum in said vacuum chamber at the maximum level in the intake port passage when the amount of air fed into the intake port passage is smaller than said predetermined value and connecting said vacuum chamber to the atmosphere when said amount of air is larger than said predetermined value.

23. An intake device according to claim 22, wherein said control apparatus comprises a check valve arranged between the intake port passage and said vacuum chamber for allowing only the outflow of air from said vacuum chamber and a control valve for controlling the fluid connection between said vacuum chamber and the atmosphere so as to connect said vacuum chamber to the atmosphere when said amount of air is larger than said predetermined value.

24. An intake device according to claim 23, wherein the engine comprises a carburetor connected to the intake port passage and having a venturi portion, said control valve being actuated in response to a change in the level of the vacuum produced in said venturi portion.

25. An intake device according to claim 24, wherein said control valve comprises a valve body for controlling the fluid connection between said vacuum chamber and the atmosphere, a vacuum cavity connected to said venturi portion, and a diaphragm connected to said valve body and actuated in response to a change in the level of the vacuum produced in said vacuum cavity.

* * * * *